US007533555B2

(12) United States Patent
Hopkins et al.

(10) Patent No.: US 7,533,555 B2
(45) Date of Patent: May 19, 2009

(54) RIVET TABLE FOR RIVET SETTING DEVICES

(75) Inventors: James L. Hopkins, Venice, FL (US); James Lyngholm, Oldsmar, FL (US); Heath Perry, Northport, FL (US); Dallas Perkins, Seminole, FL (US)

(73) Assignee: Sartam Industries, Inc., Veince, FL (US)

( * ) Notice: Subject to any disclaimer, the term of this patent is extended or adjusted under 35 U.S.C. 154(b) by 137 days.

(21) Appl. No.: 11/823,966

(22) Filed: Jun. 29, 2007

(65) Prior Publication Data

US 2009/0000347 A1 Jan. 1, 2009

(51) Int. Cl.
*B21J 15/32* (2006.01)
*B21J 15/26* (2006.01)

(52) U.S. Cl. ..... 72/391.6; 29/243.53; 29/243.521; 29/812.5

(58) Field of Classification Search ..... 29/243.53, 29/243.521, 243.523, 243.525, 809, 812.5; 72/391.6

See application file for complete search history.

(56) References Cited

U.S. PATENT DOCUMENTS

| | | | |
|---|---|---|---|
| 5,136,873 | A | 8/1992 | Hopkins et al. |
| 5,184,497 | A | 2/1993 | Hanlon et al. |
| 5,207,085 | A | 5/1993 | Hopkins et al. |
| 6,301,948 | B1 | 10/2001 | Weiland |

*Primary Examiner*—David B Jones
(74) *Attorney, Agent, or Firm*—Charles J. Prescott

(57) ABSTRACT

A rivet table connected to the nosepiece of a rivet setting apparatus. The rivet table includes an outer sleeve which controllably slides back and forth within the nosepiece and supports opposing jaws pivotally connected to the outer sleeve about spaced transverse pivot axes. The jaws pivot between a closed position and an open position, biased toward the closed position and define a flat transverse distal rivet head receiving surface, and a central mandrel-receiving aperture therebetween to slidably receive a rivet mandrel and to support the rivet head against said rivet head receiving surface during rivet setting. The jaws are momentarily forced into the open position by the mandrel moving laterally into the aperture and being carried on a flexible strip. The exposed surface of the rivet head is thereby substantially free of tool marks after being set.

3 Claims, 10 Drawing Sheets

FIG. 2
(PRIOR ART)
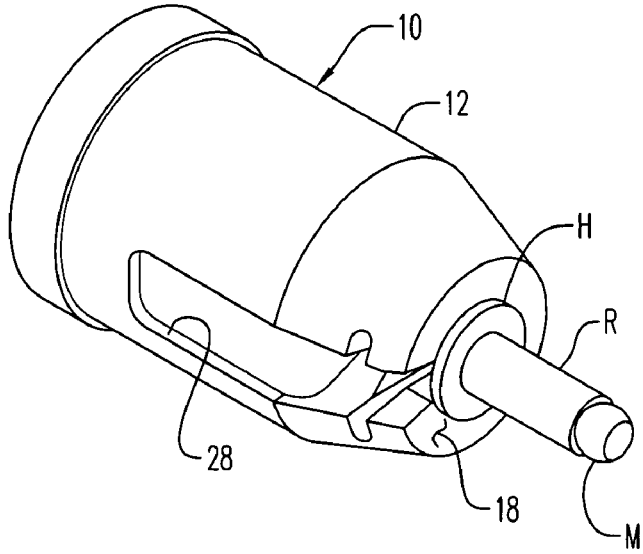
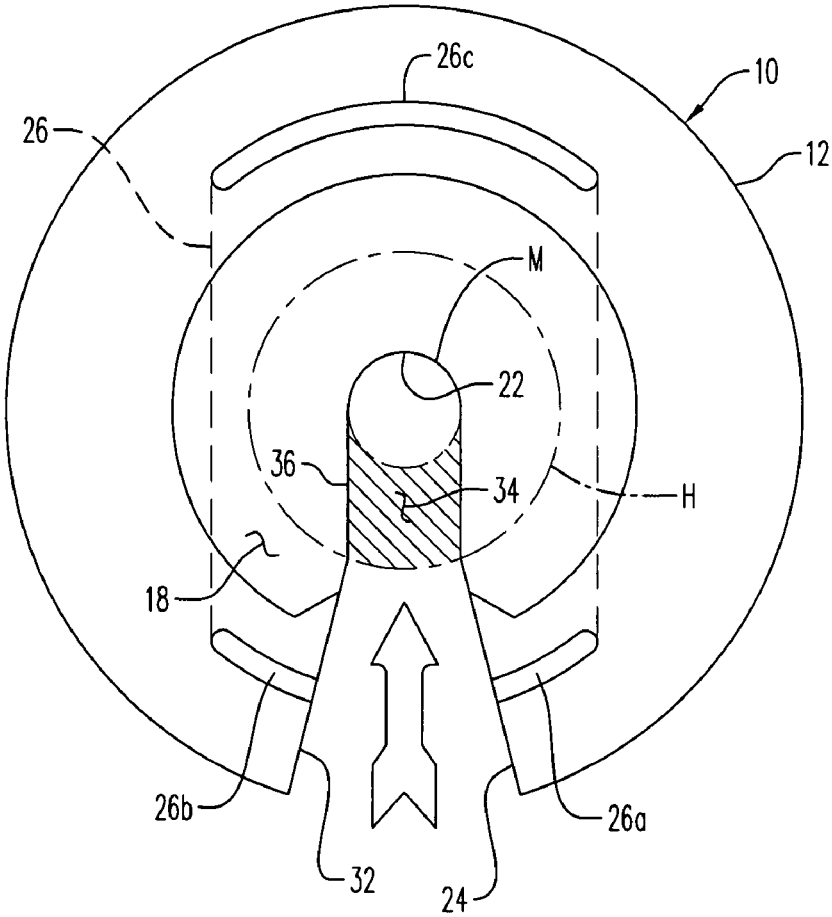
FIG. 3
(PRIOR ART)

RIVET TABLE FOR RIVET SETTING DEVICES

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to automatic rivet setting devices, and more particularly to an improved rivet table for use in such rivet setting devices.

2. Description of Related Art

The automatic blind rivet setting device disclosed in U.S. Pat. No. 5,136,873 teaches a semi-automatic loading blind rivet setting device which incorporates a distinctive feed mechanism wherein rivets set into an elongated flexible MYLAR-type strip are fed laterally into the rivet table of the device automatically one at a time after the previous rivet has been set. The flexible MYLAR strip is fed into a transverse feed slot formed through the rivet table which itself is supported on an elongated outer sleeve which translates back and forth and is forwardly biased and supported within the nosepiece of the rivet setting apparatus.

In the '873 patent as seen in FIGS. 1 to 3, the rivet table is disclosed as being fixed to or made as a unit with the outer sleeve requiring that a laterally extending slot formed into the side of the rivet table accommodate the mandrel or each rivet as it is moved into setting position within the rivet table. Because of this mandrel access slot, after the rivet is set and the mandrel fractured away, the exposed head of the rivet bears a tool mark made by the unsupported slot in the rivet table. Under normal conditions of industrial quality and integrity, the set rivet being substantially unaffected strength wise, the cosmetic blemish formed by the rivet table is normally acceptable.

However, in certain installations where the rivet head is exposed such as in situations where the body of a vehicle is assembled using exposed blind rivets set by the '873 apparatus, the tool marks formed by the slot in the distal end of the distal surface of the rivet table are objectionable. The present invention overcomes this cosmetic defect in rivets set by the '873 rivet setting apparatus by providing opposing movable jaws or arms which, when pivoted together around the mandrel, form a substantially continuous surface generally equal to or greater in size and area than that of the head of the rivet to avoid any such blemishes or tool marks during rivet setting.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a rivet table connected to the nosepiece of a rivet setting apparatus. The rivet table includes an outer sleeve which controllably slides back and forth within the nosepiece and supports opposing jaws pivotally connected to the outer sleeve about spaced transverse pivot axes. The jaws pivot between a closed position and an open position, biased toward the closed position and define a flat transverse distal rivet head receiving surface, and a central mandrel-receiving aperture therebetween to slidably receive a rivet mandrel and to support the rivet head against said rivet head receiving surface during rivet setting. The jaws are momentarily forced into the open position by the mandrel moving laterally into the aperture and being carried on a flexible strip. The exposed surface of the rivet head is thereby substantially free of tool marks after being set.

It is therefore an object of this invention to provide an improved rivet table for the blind rivet setting apparatus disclosed in U.S. Pat. No. 5,136,873.

Still another object of this invention is to provide a rivet table for an automatic rivet setting apparatus which produces rivet heads which are substantially free of cosmetic or tool marks after the rivet is set.

Yet another object of this invention is to provide an improved rivet table for the rivet setting apparatus disclosed in U.S. Pat. No. 5,136,873 whose opposing jaws freely open to receive the mandrel of each successively fed rivet into the rivet table and then automatically close around the mandrel to fully support the head of the rivet to reduce or eliminate imprinting tool marks into the outwardly exposed finished head of the set rivet.

And still another object of this invention is to provide a rivet table which preserves the seal of watertight rivets while being set in place.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference of the drawings and by study of the following descriptions.

BRIEF DESCRIPTION OF THE SEVERAL VIEWS OF THE DRAWING(S)

FIG. 1 is a perspective view of the one-piece rivet table and outer sleeve disclosed in U.S. Pat. No. 5,136,873.

FIG. 2 is a view of FIG. 1 showing a blind rivet in position ready for setting.

FIG. 3 is an enlarged end elevation view of FIG. 2.

Exemplary embodiments are illustrated in reference figures of the drawings. It is intended that the embodiments and figures disclosed herein are to be considered to illustrative rather than limiting.

DETAILED DESCRIPTION OF THE INVENTION

Prior Art

The disclosure in U.S. Pat. No. 5,136,873 is incorporated herein by reference and is made a part hereof.

Figure 1:
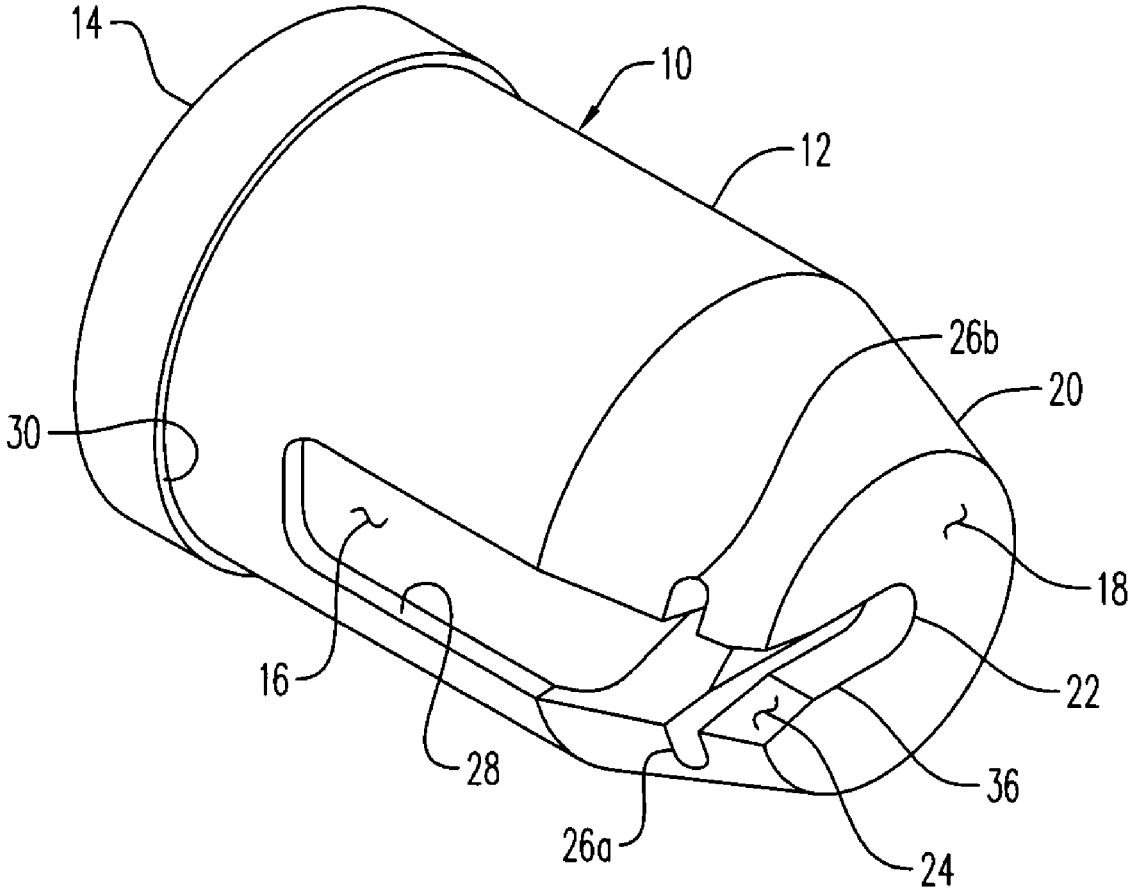
FIG. 1 (PRIOR ART)

Referring firstly to FIGS. 1 to 3, the one-piece rivet table of the '873 patent is there shown generally at numeral 10 and includes a cylindrical hollow outer sleeve 12 tapering to define a rivet table 20 and a transverse distal end surface 18. An enlarged proximal end 14 serves as a stop from outward longitudinal translation of the rivet table 10, the outer sleeve 12 being slidably held within the nosepiece of the '873 patent.

Formed into the distal end 18 of the rivet table 10 is an elongated slot 36 having a proximal end 22 thereof centered along the longitudinal center line of the rivet table 20 and sized to slidably receive a mandrel M of a blind rivet R inserted therein. The distal end portion 24 of this slot 36 is widenly tapered to facilitate easy alignment of each mandrel M as it is carried on a flexible MYLAR-type strip through a transverse slot 26 formed laterally through the rivet table 20 as best seen in FIG. 3 and as further described in the '873 patent. The MYLAR rivet carrying strip is inserted into the slot portions 26*a* and 26*b* and exits through 26*c* of the transverse slot 26. An elongated longitudinally extending mandrel-receiving slot 28 allows the mandrel M of each rivet R to pass into the hollow interior 16 of the rivet table 10.

As best seen in FIG. 3, a portion of the outer surface of the head H of the rivet R shown at 34 in cross hatch section is unsupported by the distal surface 18 of the rivet table 10. As a result, the vigorous force necessary to set the rivet R and fracture the mandrel M from the head H after being set is typically sufficiently high so that a tool mark in the shape of the unsupported area 34 is left in the exposed surface of the head H of the rivet R. As indicated in the Background, in most instances, the rivet being properly set by this apparatus is at least as strong as those set by other conventional rivet-setting devices. However, the cosmetic deformation at 34 in the exposed surface of the rivet head H can be objectionable in certain installations where the rivets are exposed such as in the assembly of commercial vehicles and busses.

The Present Invention

Figure 4:
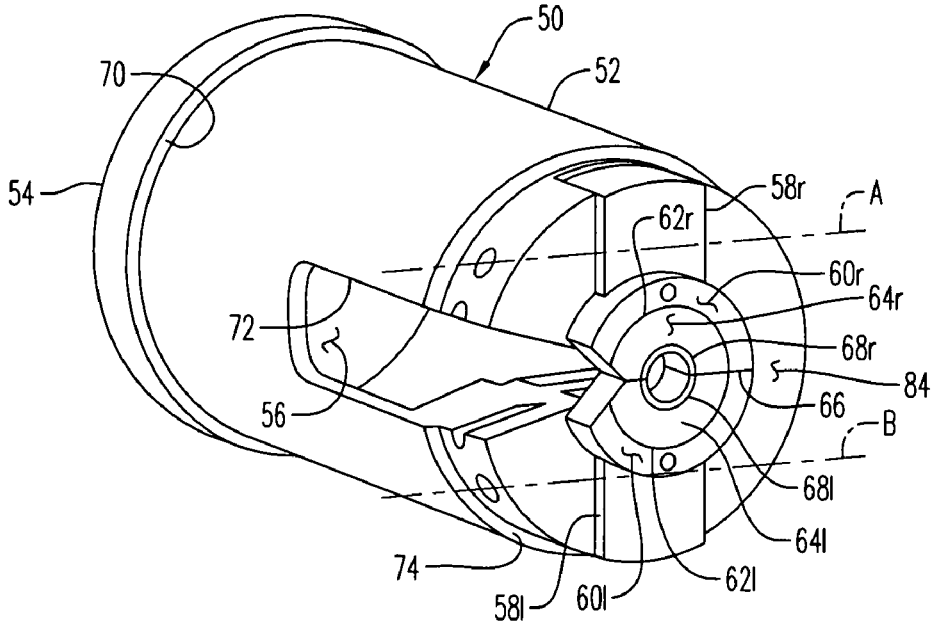
FIG. 4 is a perspective view of the new outer sleeve and rivet table of this disclosure.
Figure 5:
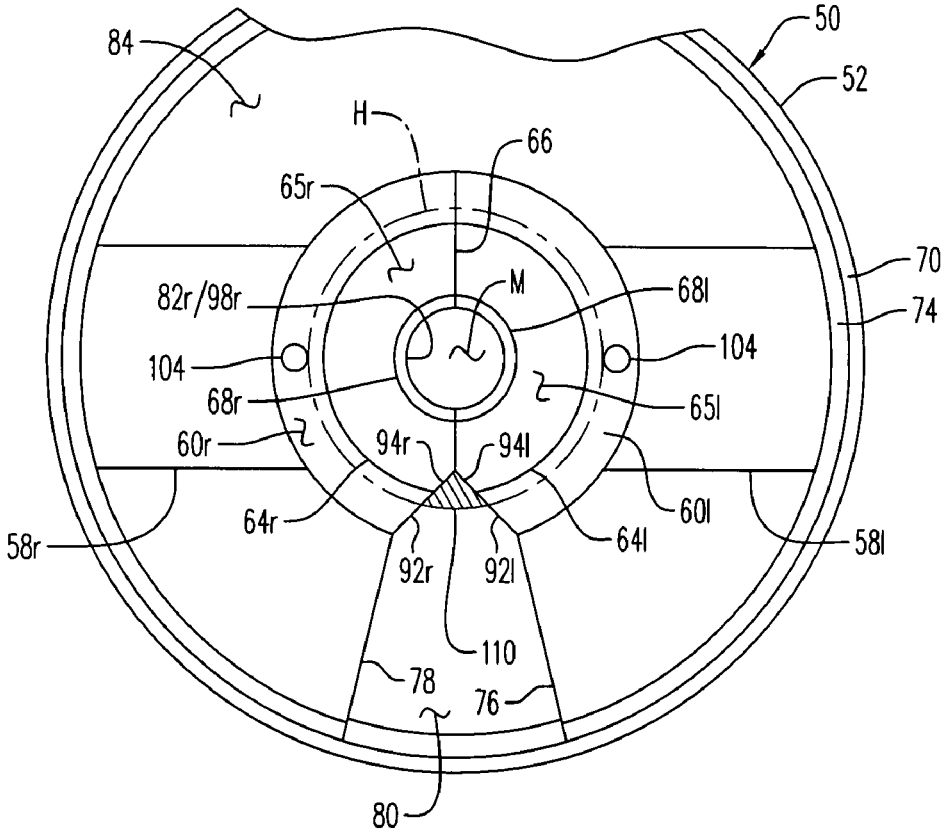
FIG. 5 is an enlarged broken end elevation view of FIG. 4.
Figure 6:
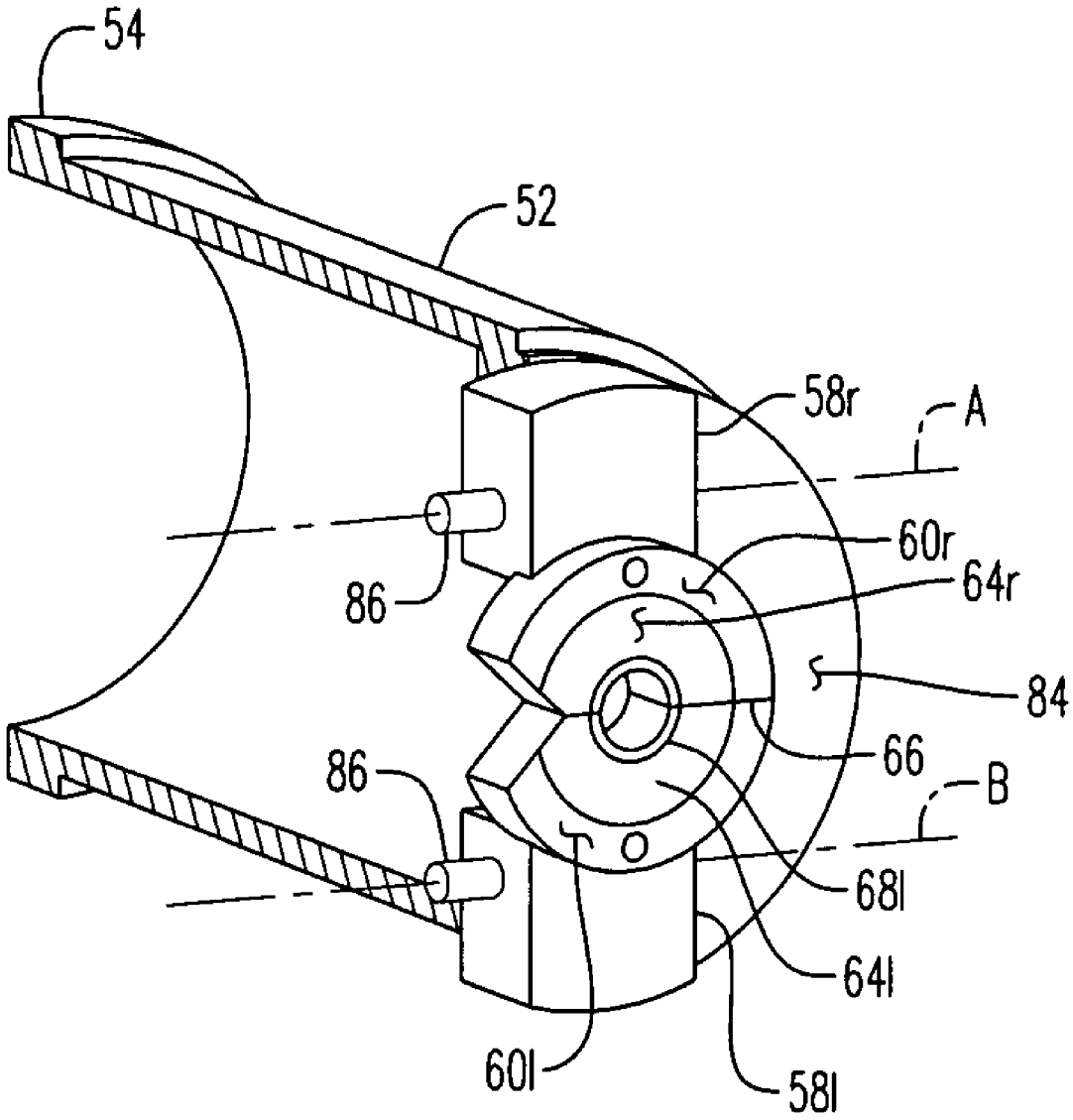
FIG. 6 is a broken view of FIG. 5.
Figure 7:
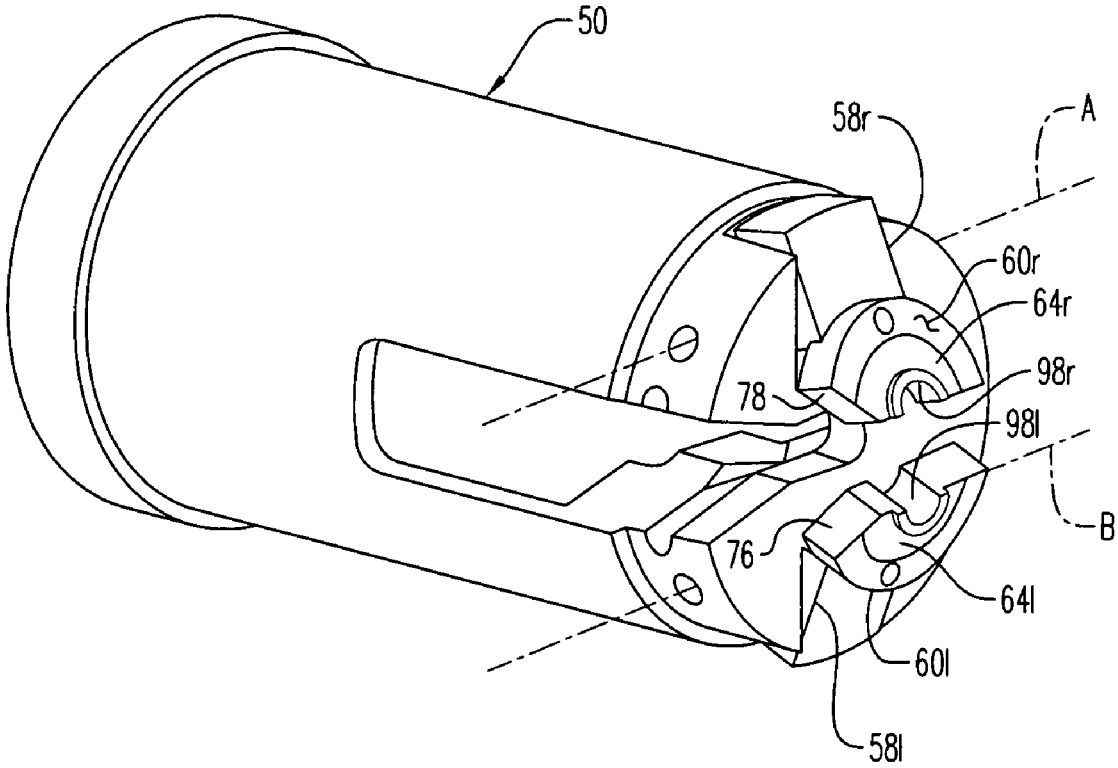
FIG. 7 is a perspective view of FIG. 5 showing the jaws in the open mandrel receiving position.

Referring now to FIGS. 2 to 12, the invention is there shown generally at numeral 50 in FIGS. 4 to 9. The rivet table 50 includes an elongated outer cylindrical hollow sleeve 52 having a hollow interior 56 similar to that previously described. An enlarged proximal end 54 for retention within the nosepiece of the '873 patent. However, in this rivet table 50 the distal end 84 of the rivet table 50 is non-functional with respect to bearing against the head H of the rivet during setting operations. Two spaced jaws or arms 58*r* and 58*l* are positioned and pivotally connected about parallel transverse axes A and B within mating slots formed into the distal surface 84. As seen in FIG. 5, each of the jaws 58*r* and 58*l* is held for pivotal movement about the respective transverse axes A and B by pins 86.

Figure 10:
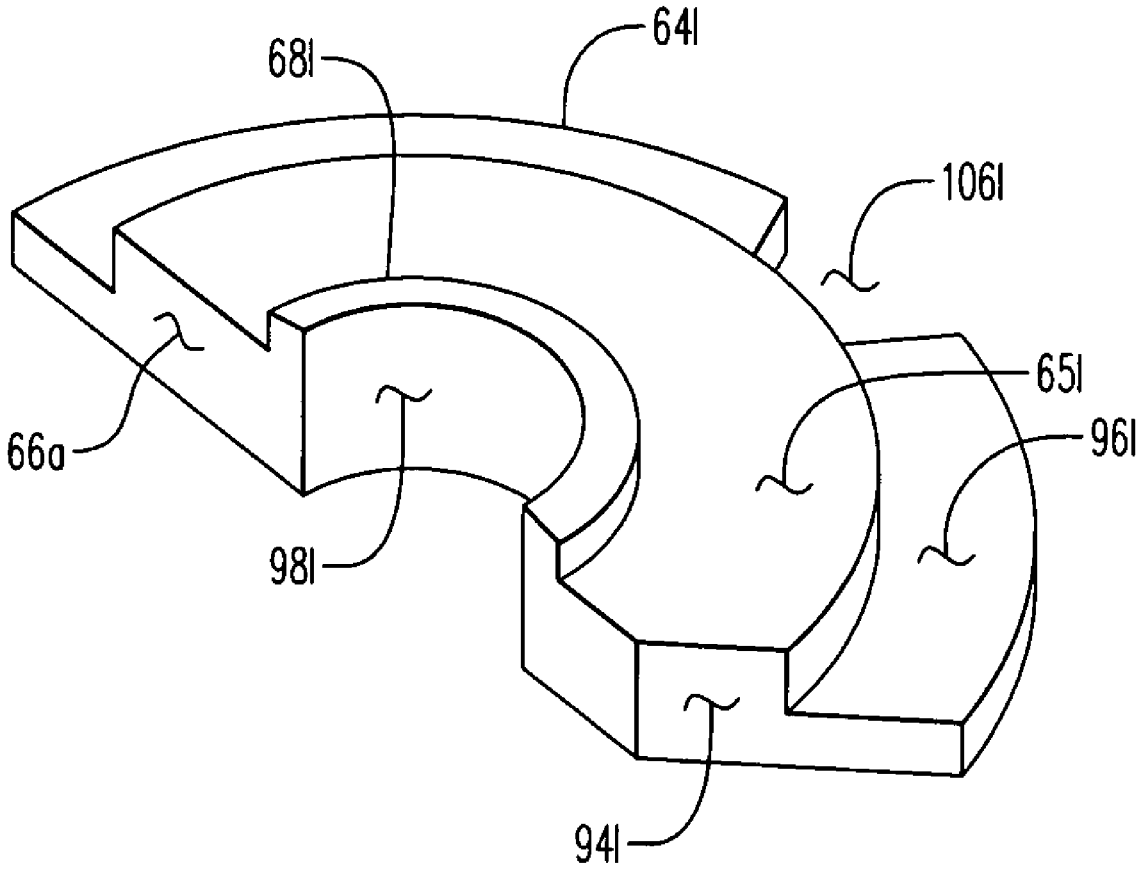
FIG. 10 is a perspective view of one of the jaw inserts of the disclosure.
Figure 11:
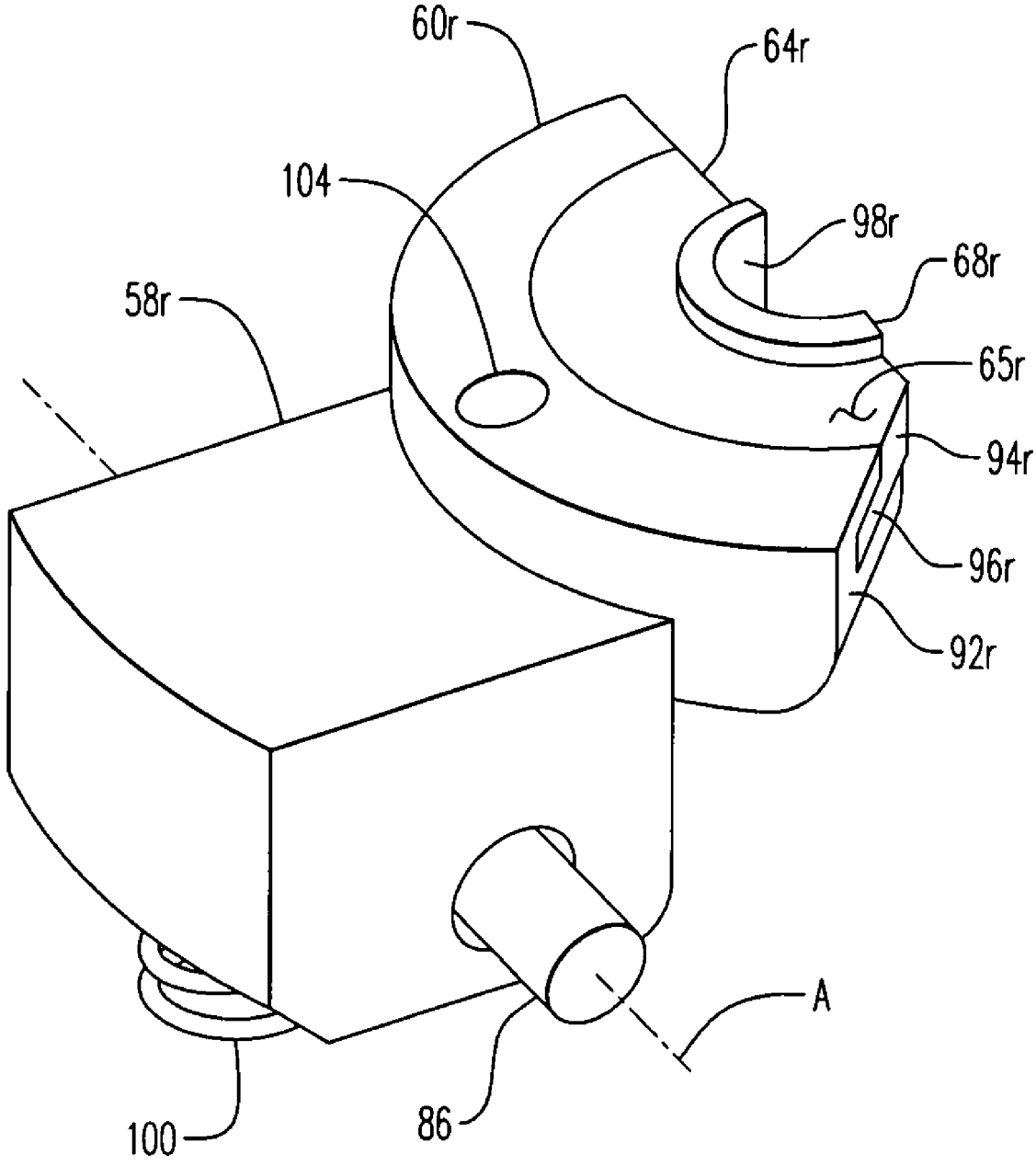
FIG. 11 is a perspective view of one of the jaws of the disclosure.
Figure 12:
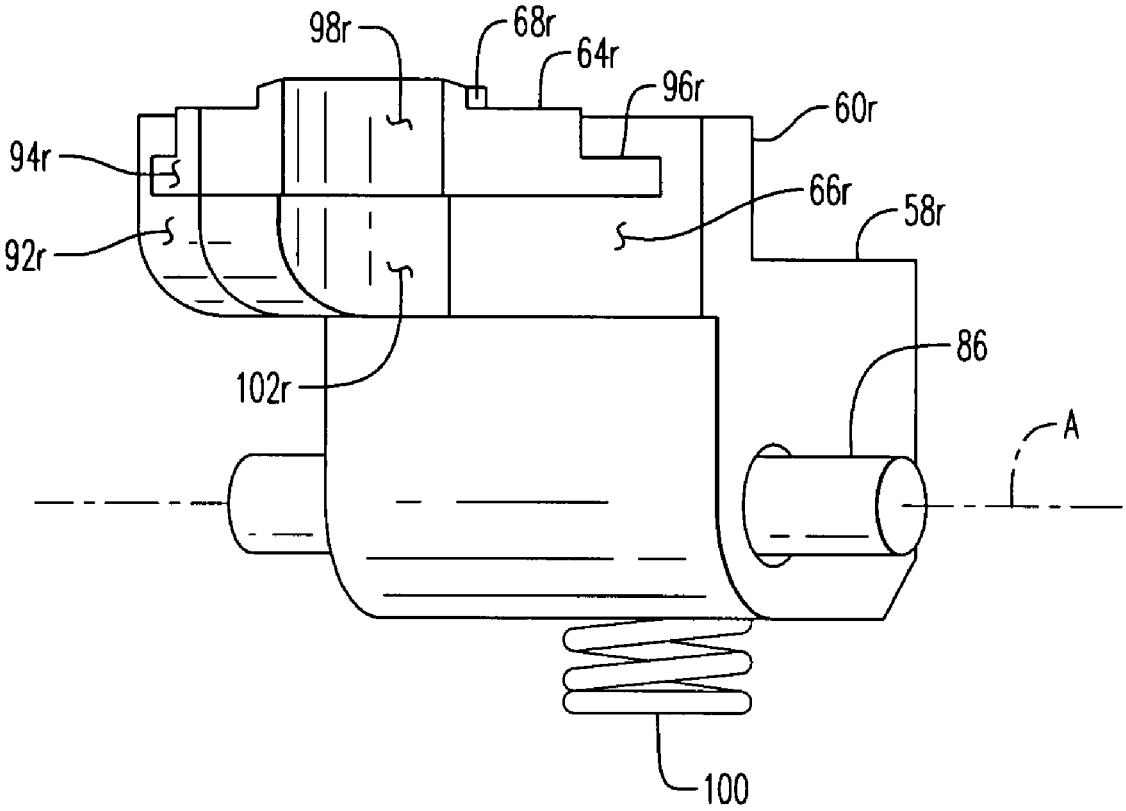
FIG. 12 is another perspective view of FIG. 11.

As best shown in FIG. 10, each of the jaws 58*r* and 58*l* receive a hardened steel insert 64*l* and 64*r*. Each of these inserts 64*l* and 64*r* includes an outer flange 96*l* and 96*r*, respectively which slidably engages into a mating cavity formed into the respective mating jaw surface of jaws 58*l* and 58*r*, respectively, as best seen in FIGS. 11 and 12. To prevent rotation of the inserts 64*r* and 64*l*, a pin 104 is inserted into a mating hole formed into the generally semi-circular jaw portions 60*r* and 60*l*, respectively which matably engages with a notch 106*l* seen in FIG. 10 and (106*r* not shown).

Each of the jaws 58*r* and 58*l* is maintained in the closed position shown in FIG. 4 by compression springs 100 which act between a cavity formed into the bottom each of the jaws 58*r* and 58*l* acting against the bottom of the machined cavities which receive each of the arms (not shown).

Figure 8:
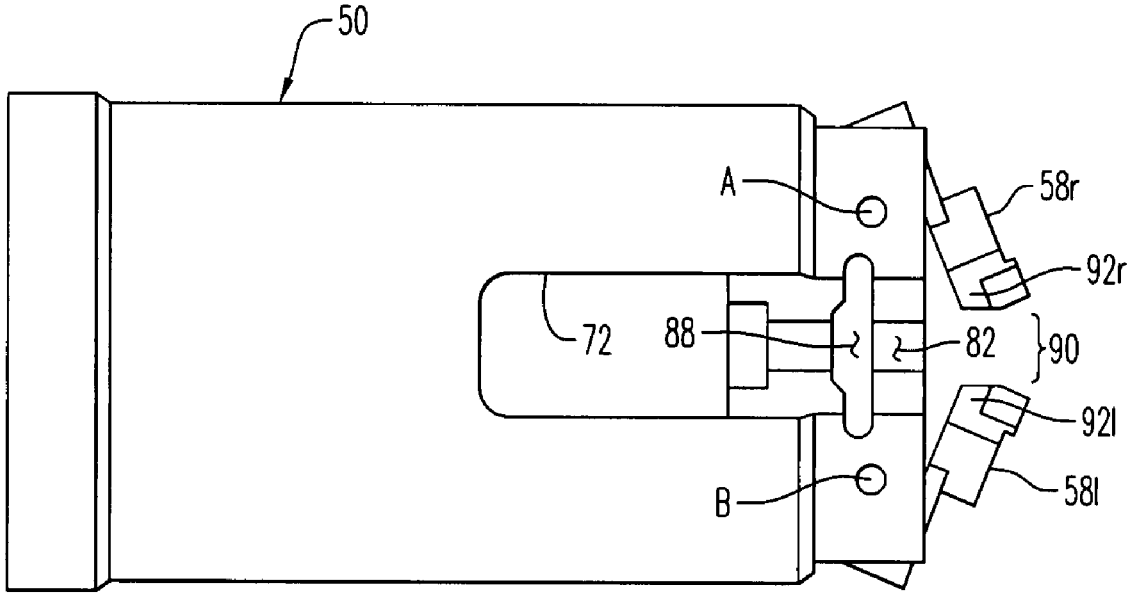
FIG. 8 is a side elevation view of FIG. 7.
Figure 9:
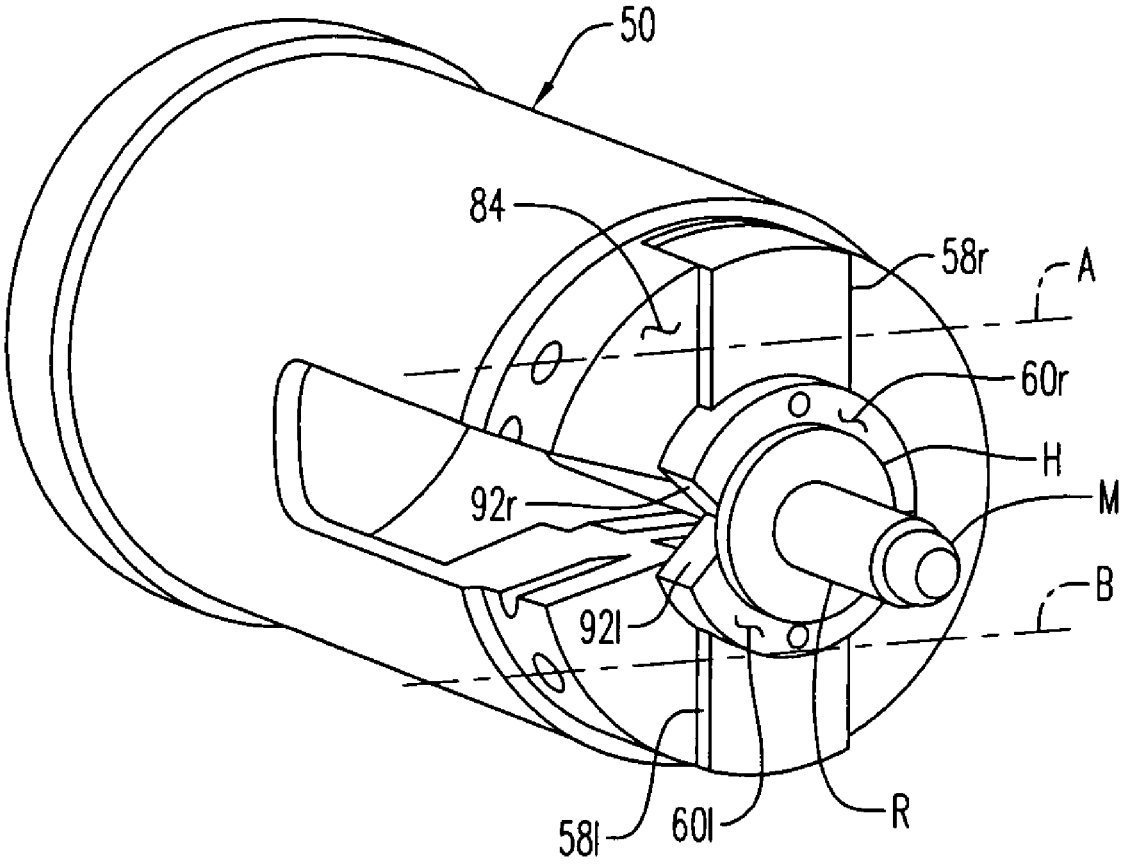
FIG. 9 is another view of FIG. 7 showing a blind rivet in position for setting.

When the mandrel M of a rivet R is moved into operative rivet-setting position within the jaws 58*r* and 58*l*, the mandrel first contacts outwardly tapered surfaces 76 and 78 best seen in FIG. 5. Thereafter, the mandrel contacts the surfaces 92*r* and 92*l* of the jaw portions 60*r* and 60*l* and then against surfaces 94*r* and 94*l* of the corresponding inserts 64*r* and 64*l*. This forces the jaws to pivotally open about axes A and B as previously described into the open position shown in FIGS. 7 and 8. The gap 90 in FIG. 8 is sufficiently wide to receive the diameter of the mandrel M whereupon, when the rivet R and the mandrel M become aligned with the mandrel-receiving aperture 82*r* and 82*l* in the corresponding jaws 58*r* and 58*l* and aperture portion 98*r* and 98*l* of inserts 64*r* and 64*l*, the jaws biasingly close into the position shown in FIGS. 4 and 9.

As with respect to the prior art rivet table, a flexible MYLAR-like strip carrying the spaced rivets pierced therethrough is slidably engaged through a transverse aperture 88 and biasingly pulled away from the rivet table 50 so as to automatically draw the next sequenced rivet held within the flexible MYLAR-like strip into ready position for setting within the closed jaws 58*r* and 58*l*. The mandrel-receiving slot 72 formed into the side wall of the outer tubular body 52 provides ready clearance for each of the mandrels M to be rapidly drawn into the hollow interior 56 of the outer sleeve 52 ready for setting.

Referring now to FIG. 5, the benefits of the present invention are there shown. The head H of the rivet R (shown in phantom) is just slightly larger than the overall diameter of the exposed transverse faces 65*r* and 65*l* of the inserts 64*r* and 64*l*, respectively. Thus, by design choice, only a small area 110 (shown in crosshatch) is left unsupported, potentially leaving only a small tool mark equal to this area at the outer perimeter of the rivet head H, assuming that the rivet head is completely flat. In many cases, however, the exposed face of the head H of the rivet is crowned and thus there would be no tool mark left at 110 at all. Moreover, increasing the diameter of the inserts 64*r* and 64*l* to make them equal to the diameter of the head H would completely eliminate any issues in this regard whatsoever.

In manufacturing installations which require a water-sealed blind rivet installation, a special water-tight D.O.T. rivet with an internal o-ring surrounding the shank of the mandrel is preferred. One product designation code for such rivets is the JoKing P-N204-4. To avoid damage to this sealing o-ring positioned internally of the head of the rivet, each of the inserts 64*r* and 64*l* include a raised ring portion 68*r* and 68*l*, respectively which are sized in thickness and length to enter into the central head of the rivet around the mandrel and protect the o-ring during the rivet setting operation.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A rivet table for a blind rivet setting apparatus, said rivet table connected at a forward distal end of a nosepiece of the apparatus which device also includes a rivet setting means dependently positioned within the nosepiece, said rivet table comprising:

an elongated substantially hollow outer sleeve dependently connected for longitudinal back and forth sliding translation within the nosepiece during setting of each rivet by the apparatus;

said outer sleeve supporting opposing jaws pivotally connected to said outer sleeve at or immediately adjacent to said end surface about spaced transverse pivot axes;

said jaws pivotable between a closed at rest position and an open position and being biased toward the at-rest position, a flat distal surface of each of said jaws collectively defining a substantially flat transverse distal rivet head receiving surface when said jaws are in the closed position;

a longitudinal mandrel receiving aperture formed centrally by and between mating surfaces of said jaws, said aperture sized, when said jaws are in the closed position, to slidably receive a rivet mandrel and to support a rivet head against said rivet head receiving surface;

a longitudinal mandrel-receiving slot formed into and extending laterally from said aperture, said jaws formed to be momentarily forced into the open position by the mandrel moving laterally into sliding orientation within the aperture;

said distal head receiving surface being of sufficient size and surface area to substantially fully support the exposed surface of the rivet head during setting of the rivet whereby the exposed surface is substantially free of tool marks after the rivet is set by the device.

2. In combination, a rivet table and a rivet carrying strip for a blind rivet setting apparatus, said rivet table connected at a forward distal end of a nosepiece of the apparatus which device also includes a rivet setting means dependently positioned within the nosepiece, said rivet table comprising:

an elongated rivet strip formed of thin flexible material holding a plurality of blind rivets connected in spaced apart relation along the length of said strip by having a distal portion of each mandrel of each rivet pierced through or fitted into holes formed through said strip;

an elongated substantially hollow outer sleeve dependently connected for longitudinal back and forth sliding translation within the nosepiece during setting of each rivet by the apparatus;

said outer sleeve supporting opposing jaws pivotally connected to said outer sleeve at or immediately adjacent to said end surface about spaced transverse pivot axes;

said jaws pivotable between a closed at rest position and an open position and being biased toward the at-rest position, a flat distal surface of each of said jaws collectively defining a substantially flat transverse distal rivet head receiving surface when said jaws are in the closed position;

a longitudinal mandrel receiving aperture formed centrally by and between mating surfaces of said jaws, said aperture sized, when said jaws are in the closed position, to slidably receive a rivet mandrel and to support a rivet head against said rivet head receiving surface;

a longitudinal mandrel-receiving slot formed into and extending laterally from said aperture, said jaws formed to be momentarily forced into the open position by the mandrel moving laterally into sliding orientation within the aperture;

a transverse rivet strip feed slot formed transversely through said outer sleeve adjacent to said rivet head receiving surface, said feed slot sized to slidably receive said rivet strip passing there through as one rivet at a time held on said rivet strip is positioned in said aperture for setting;

said distal head receiving surface being of sufficient size and surface area to substantially fully support the exposed surface of the rivet head during setting of the rivet whereby the exposed surface is substantially free of tool marks after the rivet is set by the device.

3. A rivet table for a blind rivet setting apparatus, said rivet table connected at a forward distal end of a nosepiece of the apparatus which device also includes a rivet setting means dependently positioned within the nosepiece, said rivet table comprising:

an elongated substantially hollow outer sleeve dependently connected for longitudinal back and forth sliding translation within the nosepiece during setting of each rivet by the apparatus;

said outer sleeve supporting opposing jaws pivotally connected to said outer sleeve at or immediately adjacent to said end surface about spaced transverse pivot axes;

said jaws pivotable between a closed at rest position and an open position and being biased toward the at-rest position, each of said jaws including a replaceable jaw insert secured to each of said jaws and defining a substantially flat transverse distal rivet head receiving surface when said jaws are in the closed position;

a longitudinal mandrel receiving aperture formed centrally by and between grooves formed into mating surfaces of said jaws and said jaw inserts, said aperture sized, when said jaws are in the closed position, to slidably receive a rivet mandrel and to support a rivet head against said rivet head receiving surface;

a longitudinal mandrel-receiving slot formed into and extending laterally from said aperture, said jaws formed to be momentarily forced into the open position by the mandrel moving laterally into sliding orientation within the aperture;

a transverse rivet strip feed slot formed transversely through said outer sleeve adjacent to said rivet head receiving surface, said feed slot sized to slidably receive said rivet strip passing there through as one rivet at a time held on said rivet strip is positioned in said aperture for setting;

said distal head receiving surface being of sufficient size and surface area to substantially fully support the exposed surface of the rivet head during setting of the rivet whereby the exposed surface is substantially free of tool marks after the rivet is set by the device.

* * * * *